US005839249A

United States Patent [19]

Roberts

[11] Patent Number: 5,839,249

[45] Date of Patent: Nov. 24, 1998

[54] FOAM BLOCK WALL AND FABRICATION METHOD

[76] Inventor: Scott J. Roberts, 1730 N. Kittredge Rd., Flagstaff, Ariz. 86001

[21] Appl. No.: 730,940

[22] Filed: Oct. 16, 1996

[51] Int. Cl.[6] ..... E04B 1/00

[52] U.S. Cl. ..... 52/745.08; 52/742.12; 52/439; 52/562

[58] Field of Search ..... 52/223.7, 434, 52/442, 439, 566, 606, 503, 505, 562, 742.1, 742.12, 742.16, 745.05, 745.08

[56] References Cited

U.S. PATENT DOCUMENTS

| | | | |
|---|---|---|---|
| 2,176,986 | 10/1939 | Briscoe | 72/30 |
| 3,166,873 | 1/1965 | Rosenfeld | 52/439 |
| 3,382,632 | 5/1968 | Grofcsik | 52/223.7 |
| 3,430,404 | 3/1969 | Muse | 52/439 |
| 3,552,076 | 1/1971 | Gregori | 52/309 |
| 3,788,020 | 1/1974 | Gregori | 52/309 |
| 4,041,670 | 8/1977 | Kaplan | 52/591 |
| 4,048,778 | 9/1977 | Krings | 52/615 |
| 4,249,354 | 2/1981 | Wynn | 52/439 X |
| 4,429,499 | 2/1984 | Kato | 52/223.7 |
| 4,475,326 | 10/1984 | Hanson | 52/286 |
| 4,726,567 | 2/1988 | Greenberg | 52/223.7 X |
| 4,731,279 | 3/1988 | Isshiki | 428/159 |
| 4,835,928 | 6/1989 | Scott | 52/434 X |
| 4,862,660 | 9/1989 | Raymond | 52/221 |
| 5,024,035 | 6/1991 | Hanson et al. | 52/591 |
| 5,265,389 | 11/1993 | Mazzone et al. | 52/309.7 |
| 5,279,089 | 1/1994 | Gulur | 52/309.11 |
| 5,303,529 | 4/1994 | Guardia | 52/745.15 |
| 5,371,990 | 12/1994 | Salah Uddin | 52/379 |
| 5,426,904 | 6/1995 | Gilmore | 52/489.1 |
| 5,457,926 | 10/1995 | Jensen | 52/604 |
| 5,566,517 | 10/1996 | Ishii et al. | 52/439 X |

FOREIGN PATENT DOCUMENTS 826584 11/1969 Canada .

*Primary Examiner*—Lanna Mai

[57] ABSTRACT

Foam blocks including vertical passageways are aligned by a block alignment element having first and second edge alignment surfaces for simultaneously engaging the internal block passageways at angularly spaced apart intervals to align one block relative to another block.

20 Claims, 4 Drawing Sheets

FOAM BLOCK WALL AND FABRICATION METHOD

BACKGROUND OF THE INVENTION

1. Field of the Invention

This invention relates to foam block walls, and more particularly, to block walls including vertically extending block alignment elements.

2. Description of the Prior Art

The prior art discloses a variety of wall designs fabricated from a plurality of stackable insulating foam blocks. For example, U.S. Pat. No. 5,024,035 (Hanson) discloses an interlocking, structural foam block having vertical channels. Hanson fails to disclose any technique for accurately aligning the blocks prior to grouting the block cells with cement.

U.S. Pat. No. 5,457,926 (Jensen) discloses interlocking foam building blocks, but Jensen's design fails to overcome the problem of attaching wall-mounted devices to the wall system or a fail-safe technique for vertically and horizontally aligning the discrete block elements into a straight wall.

U.S. Pat. No. 3,788,020 (Gregori) discloses a self-supporting concrete form made from foamed polymeric material left in place after the concrete has been poured. A thin, heat conductive transverse member connects the inner and outer wall forms, but greatly reduces the insulating capability of the wall because that transverse member also functions as a thermal bridge. The Gregori wall design requires an inner frame structure to mount interior walls, electrical conduit and junction boxes, and cabinets. Gregori fails to disclose an effective technique for aligning adjacent wall elements.

U.S. Pat. No. 4,862,660 (Raymond) discloses a foam wall formed around a plastic load bearing member. While the Raymond wall design provides for placement of wall-mounted devices, the load bearing columns function as a thermal bridge significantly reducing the wall insulating efficiency.

U.S. Pat. No. 4,731,729 (Isshiki) discloses a foam block wall reinforced by a bar inserted through the bores of selected blocks. While that bar may reinforce the strength of the wall, Isshiki does not teach the use of a vertical reinforcement member to align a wall, nor the use of a vertical reinforcement member for mounting structures to the wall.

SUMMARY OF THE INVENTION

It is therefore a primary object of the present invention to provide a foam block or heating insulating wall including a vertically extending block alignment element capable of laterally aligning each of a plurality of vertically stacked blocks relative to one another.

Another object of the present invention is to provide a foam block wall which can be accurately aligned by a block alignment element prior to grouting adjacent cells with concrete.

Yet another object of the present invention is to provide a foam block wall with a coupling surface forming a part of each block alignment element for receiving and retaining elongated fastening devices penetrating through the block sidewall.

Yet another object of the present invention is to provide a foam block wall having a block alignment element including a coupling surface for allowing wall-mounted devices such as drywall, electrical boxes and siding to be directly coupled to and supported by the exterior surface of the block wall by mechanical means.

Briefly stated, and in accord with one embodiment of the invention, a foam block wall includes a first foam block having an upper surface, a lower surface, opposing parallel-oriented exterior side surfaces and a first passageway extending vertically between the upper and lower block surfaces and defining a reduced thickness sidewall between the exterior side surface and the internal passageway. A second foam block includes and upper surface, a lower surface, opposing parallel-oriented exterior side surfaces and a second passageway extending vertically between the upper surface and lower block surface defining a reduced thickness sidewall between the exterior surface and the internal passageway. The lower surface of the second block is supported by the upper surface of the first block with the second passageway aligned with the first passageway. A block alignment element includes a first end, a second end and first and second edge alignment surfaces disposed between the first and second ends for simultaneously engaging the internal passageways of the first and second blocks at angularly spaced apart intervals to align the first and second blocks.

As an additional element of the invention, the block alignment elements may also be provided with a coupling surface positionable in proximity to the reduced thickness sidewall of at least one block to receive and retain elongated fastening devices penetrating through the sidewall and engaging the coupling surfaces.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
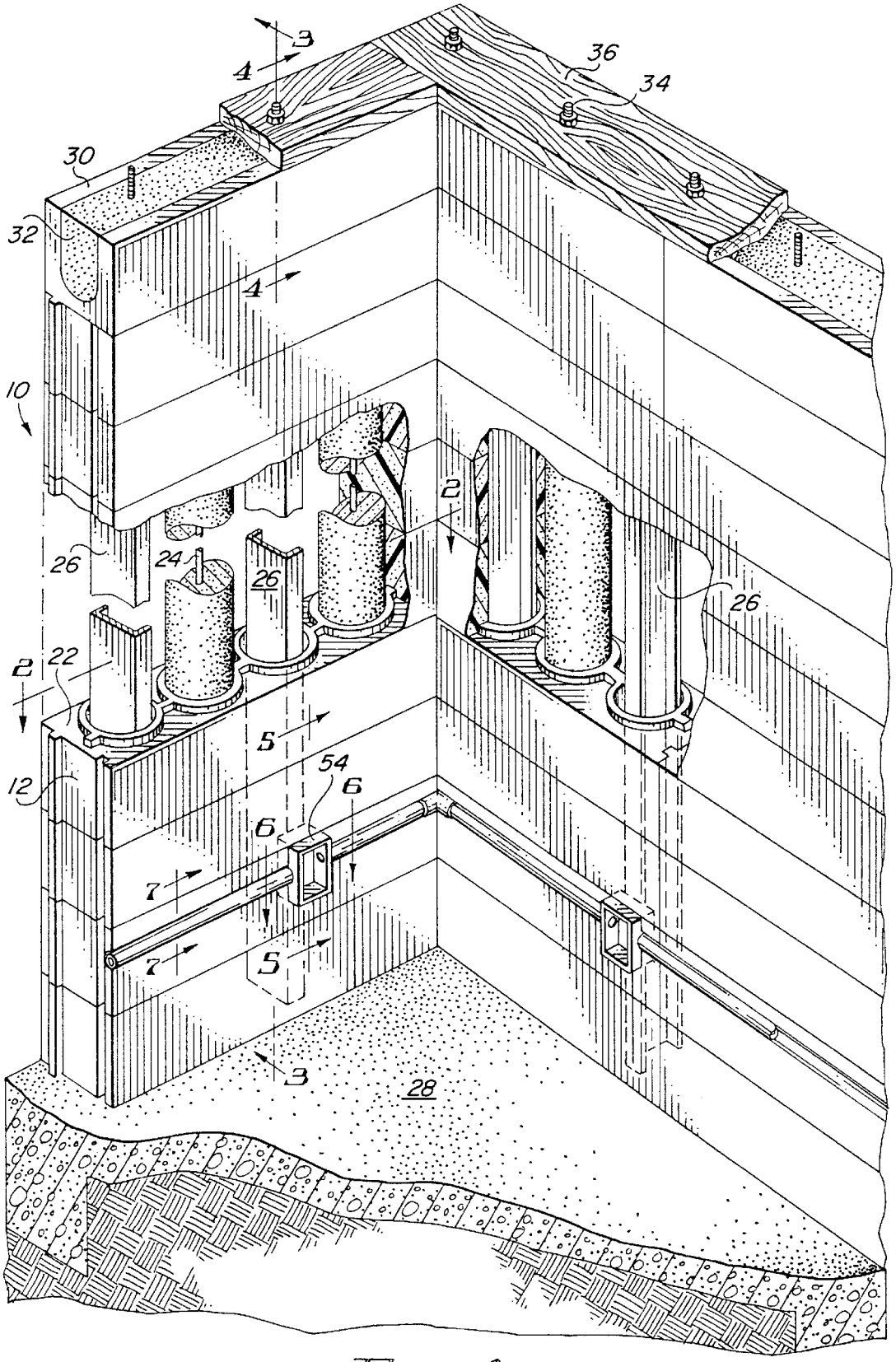
FIG. 1 represents a partially cutaway perspective view of one embodiment of the foam block wall of the present invention.
Figure 3:
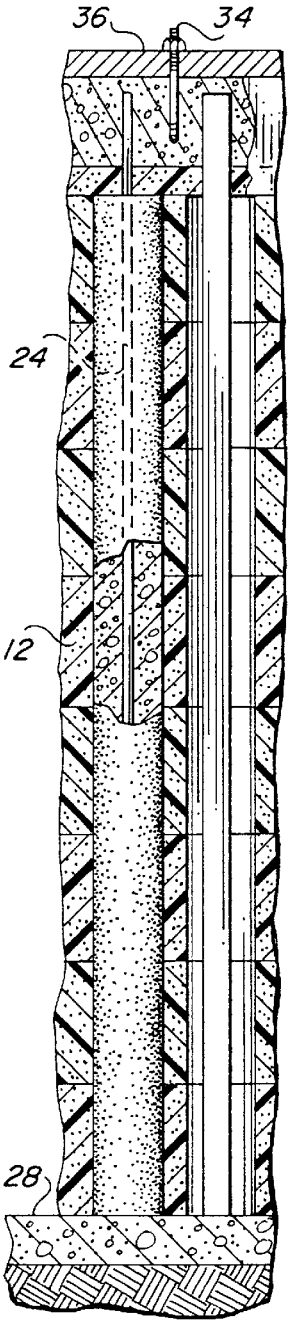
FIG. 3 represents a partially cutaway elevational view of the block wall illustrated in FIG. 1, taken along section lines 3—3.
Figure 2:
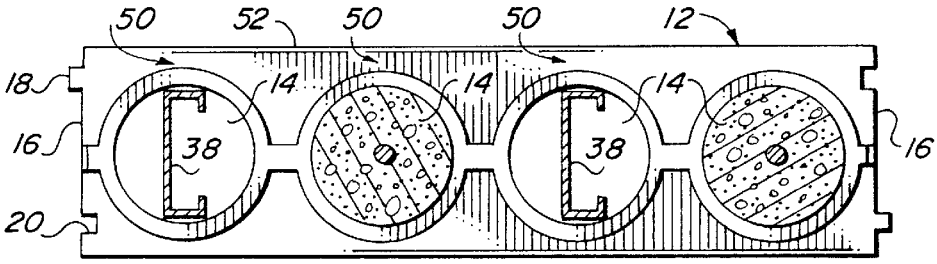
FIG. 2 represents a sectional view of the block wall illustrated in FIG. 1, taken along section lines 2—2.

FIGS. 1, 2 and 3 illustrate a heat insulating block wall 10 constructed from a plurality of conventional prefabricated urethane or polystyrene foam blocks 12. As illustrated in FIGS. 1 and 2, each foam block 12 includes a series of four laterally spaced apart, vertically oriented cylindrical passageways 14. Each block includes an end surface 16 including a tongue and groove system for interfacing and locking together the ends of adjacent blocks. As illustrated in FIG. 2, each tongue and groove end section includes a tongue element 18 and a groove element 20.

As illustrated in FIG. 1, a similar tongue and groove block interlocking system is utilized on the block upper surface 22 with a complementary pattern on the lower surface of adjacent blocks to interlock adjacent blocks together in the vertical direction.

The block wall of the present invention may be assembled above a conventional foundation and footer arrangement 28 as illustrated in FIGS. 1 and 3 with reinforcing bars or rebar 24 extending vertically upward through every other vertically oriented passageway as illustrated in FIG. 3.

During construction of a heat insulating block wall according to the present invention, a series of foam blocks 12 are stacked up to form an unsecured wall having an appropriate length and height. Before grouting the rebar containing cells with concrete, it is critical to precisely align the plurality of blocks both vertically as well as laterally. This block alignment function is accomplished by inserting a series of block alignment elements 26 through the open passageways of the highest blocks until the base of each block alignment element contacts the supporting concrete slab 28. During this insertion operation, block alignments 26 should be jiggled or rotated to assist in implementing the alignment function as they are inserted through the uppermost block toward slab 28. After block alignment elements 26 have been inserted into all of the open passageways 14, the individual blocks 12 forming wall 10 will be precisely aligned, causing the entire wall system comprising a plurality of previously unsecured blocks to become a relatively rigid, stand-alone integrated wall. This partially completed, but substantially rigidified wall is capable of resisting high level wind loads on a temporary basis until the remaining passageways 14 have been grouted with concrete.

Figure 4:
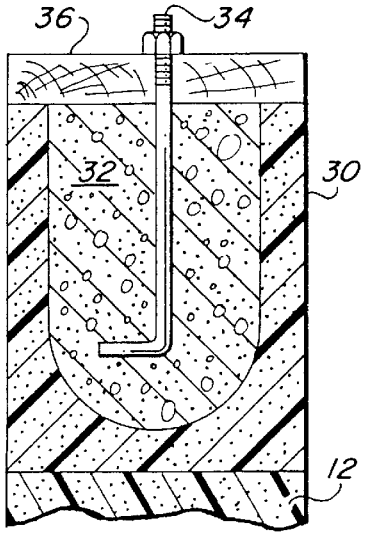
FIG. 4 represents a partially cutaway elevational view of the block wall illustrated in FIG. 1, taken along sections 4—4.
Figure 5:
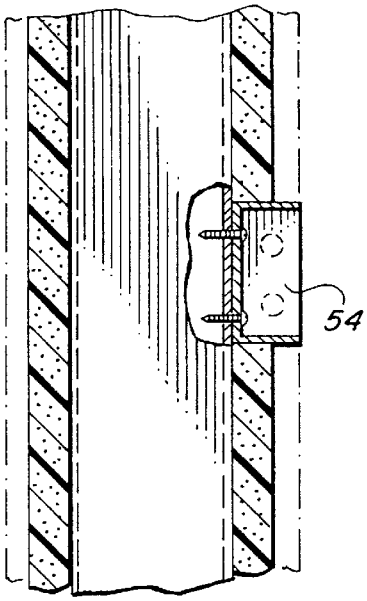
FIG. 5 represents a partially cutaway elevational view of the block wall illustrated in FIG. 1, taken along section lines 5—5.

FIGS. 1, 3 and 4 illustrate how a second urethane foam block configuration 30 is provided to function as wall cap. Each block 30 includes a horizontally oriented, U-shaped channel. Although not illustrated in the drawings, blocks 30 include tongue and groove coupling elements on the end surfaces and on the lower surfaces similar to those described in connection with blocks 12.

The lateral spacing between the tongue and groove structure is preferably sufficient to allow those coupling elements to remain intact when the interior portion of block 30 is cut out and removed to form bond beam 30 as shown in FIG. 4. As illustrated FIG. 4, a conventional J-bolt 34 and wood plank 36 mounting system facilitates coupling the wall system of the present invention to other building structures.

Figure 6:
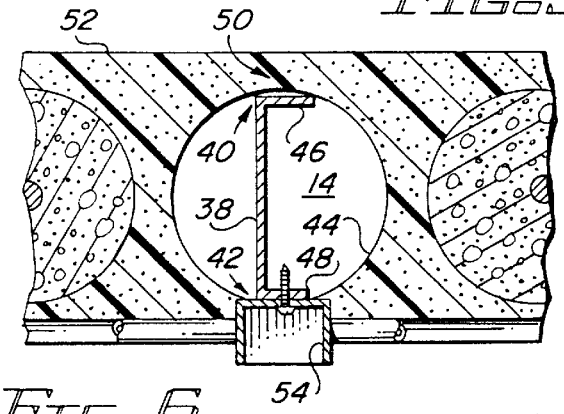
FIG. 6 represents a partially cutaway elevational view of the block wall illustrated in FIG. 1, taken along section line 6.6

As illustrated in FIGS. 1, 2 and 6, a preferred embodiment of block alignment 26 includes a conventional metal C-channel 38 of the type typically used in modern residential and commercial construction as a replacement for wooden wall studs. The block passageways 14 are dimensionally configured to precisely accommodate such C-channel structures 38.

Each block alignment element 26 in the form of C-channel 38 includes a first edge alignment surface 40 and a second edge alignment surface 42 which relatively tightly engage the inner cylindrical surface 44 of passageway 14. C-channel alignment element 38 further includes a first coupling surface 46 and a second coupling surface 48. The ends or outer corners of these two coupling surfaces also contact and engage inner surface 44 of passageway 14. As a direct result of the engagement between the four edges or corners of C-channel 38 with the interior surface 44 of passageway 14 along the vertical dimension of C-channel 38, the semi-rigid galvanized or coated metal structure of C-channel 38 gradually relocates and aligns a series of vertically stacked blocks as it is inserted downward through passageway 14. Wooden, plastic or any other material capable of being rigid for alignment purposes and capable of holding fasteners such as screws may be used as a substitute for a metal alignment element 38.

The insertion and jiggling of C-channel 38 during its downward travel within passageway 14 allows the spring-like structure of C-Channel 38 to gradually displace unaligned blocks 12 into a precisely aligned configuration. The cooperative and additive effect of the alignment forces generated by a plurality of inserted C-channel alignment elements exerts relatively high level block alignment forces and not only facilitates the initial alignment of a plurality of blocks, but also generates and continuously maintains relatively high order block alignment forces preventing blocks 12 from subsequently becoming misaligned by wind generated or equivalent intermittent forces.

Depending on structural requirements, most applications of the present invention will involve concrete grouting of a selected number of spaced apart passageways 14 or cells such as illustrated in FIG. 1 which depicts the grouting of every other cell with concrete. During the grouting operation, the alignment forces exerted by alignment elements 38 maintains the blocks in the desired aligned position and prevents unintended contacts with the block wall structure from displacing individual blocks out of the aligned position. Accordingly, when the concrete cures, a fully aligned, high strength wall remains.

Figure 7:
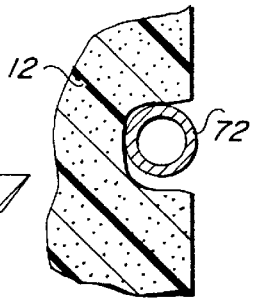
FIG. 7 represents a partially cutaway elevational view of the block wall illustrated in FIG. 1, taken along section lines 7—7.
Figure 8:
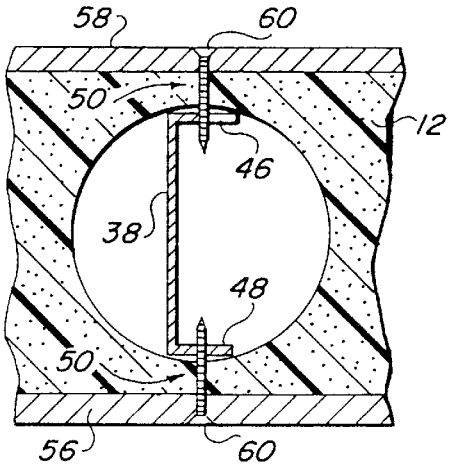
FIG. 8 represents a partially cutaway elevational view of a C-shaped block alignment element including fastening devices penetrating through both the interior and exterior sidewalls of the block for securing wall-mounted devices to the outside and inside of the block wall.

In addition to assisting with the block alignment function, coupling surfaces 46 and 48 also provide a highly advantageous method for attracting or securing wall-mounted devices such as drywall, siding, plumbing, electrical conduit and junction boxes directly to the outer surface of the block wall 10. As illustrated in FIGS. 2 and 7, a reduced thickness sidewall region 50 is created between interior surface 44 of passageway 14 and exterior surface 52 of individual blocks 12. As most clearly illustrated in FIGS. 1 and 6, an electrical junction box 54 can be fitted within a countersunk recess cut directly into the side of a section of block wall 10. An elongated fastening device such as a screw can readily be passed through the vertically oriented, rear sidewall of junction box 54 such that it penetrates directly through sidewall 50 and engages coupling surface 48 to secure junction box 54 directly to C-channel alignment element 38. As illustrated in FIG. 8, screws or equivalent elongated fastening devices can be drilled directly through a sheet of drywall 56 to directly mount the drywall surface to the exterior surface of blocks 12. Similarly, as illustrated in FIG. 8, siding 58 as well as many other materials or structures can be directly mounted to the opposite side of blocks 12 by fastening devices such as screws 60.

The tension force generated by fastening device 60 between drywall sheet 56 and the relatively large surface area of coupling surface 48 compresses the portion of block 12 lying within reduced thickness sidewall area 50 and provides substantial holding forces for securing various materials to C-channel 38 which serves as an internalized mounting or coupling structure.

The unique coupling and mounting configuration of the present invention allows various other types of wall-mounted devices such as cabinets, plumbing structures, shutters and numerous other building structures and accessories to readily be directly attached to and detached from the exterior surface wall structure 10 of the present invention.

Figures 11, 12, 13, 14, 15, 16:
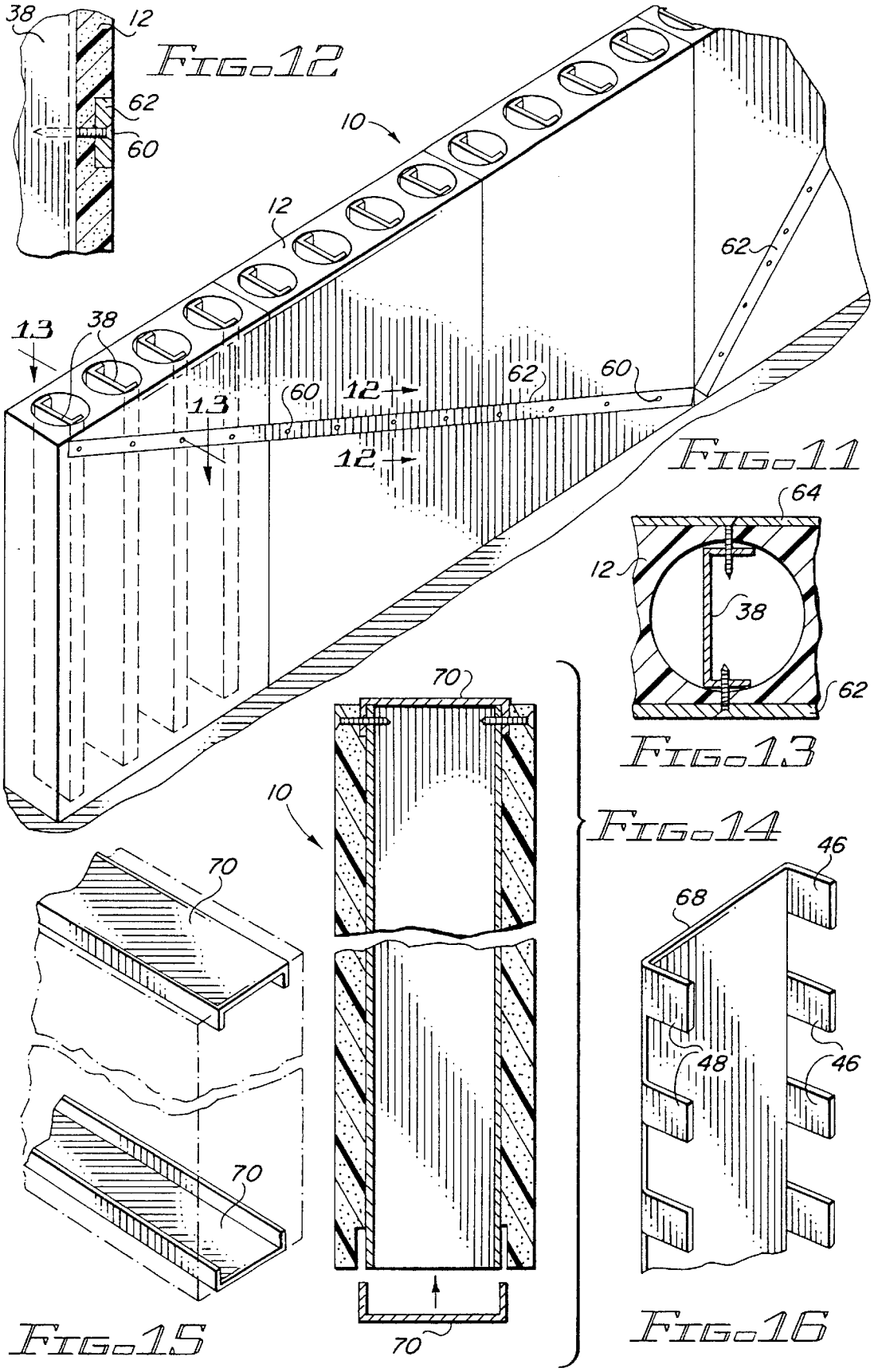
FIG. 11 illustrates a foam block wall fabricated from a series of foam blocks, including a series of load bearing capable block alignment elements together with a diagonal block wall brace illustrating the use of foam blocks without the use of concrete.
FIG. 12 represents a partially cutaway elevational view of the block wall illustrated in FIG. 11, taken along section lines 12—12.
FIG. 13 represents a partially cutaway elevational view of the block wall illustrated in FIG. 11, taken along section lines 13—13.
FIG. 14 represents a partially cutaway cross-sectional view of a block wall including wall-mounted devices on the exterior and interior surface and caps on the top and bottom.
FIG. 15 represents a partially cutaway perspective view of the wall illustrated in FIG. 14.
FIG. 16 represents a partially cutaway perspective view of a block alignment element including spaced apart coupling surface elements.

As illustrated in FIG. 11, a diagonal brace 62 can be configured to extended at an angle across a substantial length of blocks 12 to provide a significant enhancement in wall rigidity, either with or without concrete reinforcement by additional concrete grouting. As illustrated in FIG. 11, concrete grouting and rebar have been eliminated and instead a C-channel block alignment element 38 has been inserted into each vertically oriented passageway 14 of the block wall system. FIG. 13 illustrates how brace 62 may be attached to one side of block wall 10 while another wall-mounted device 64 is attached to the opposite exterior surface of blocks 12. FIG. 12 illustrates that brace 62 may be embedded or recessed in the exterior surface 52 of blocks 12 to maintain a flush wall surface which does not interfere with the addition of yet another form of wall-mounted device.

Figure 9:
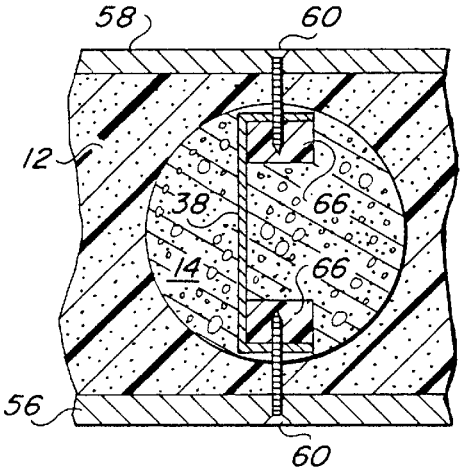
FIG. 9 represents a partially cutaway elevational view of a modified C-shaped block alignment element including fastening strips for securing wall-mounted devices to the exterior and interior sidewalls of the block where the previously open block passageway has been filled with cured concrete.

FIG. 9 illustrates yet another modification of the present invention where foam, wood or equivalent strips 66 have been secured to coupling surfaces 46 and 48 of C-channel 38 to displace concrete. In this embodiment of the invention, C-channel 38 replaces rebar and accommodates concrete grouting. Strips 66 allow fastening devices 60 to penetrate through coupling surfaces 46 and 48 and to further penetrate into strips 66, a function which could not be performed were strip 66 omitted and that volume replaced by solid concrete. The modified structure of block alignment element 38 permits fastening devices 60 to be inserted, removed and replaced at will without interference from the solidly grouted concrete interior within passageway 14.

FIG. 16 illustrates a different configuration of block alignment element 68 which includes coupling surfaces 46 and 48 which are disposed at spaced apart intervals along an appropriate length or length segment of alignment element 68.

Figure 10A:
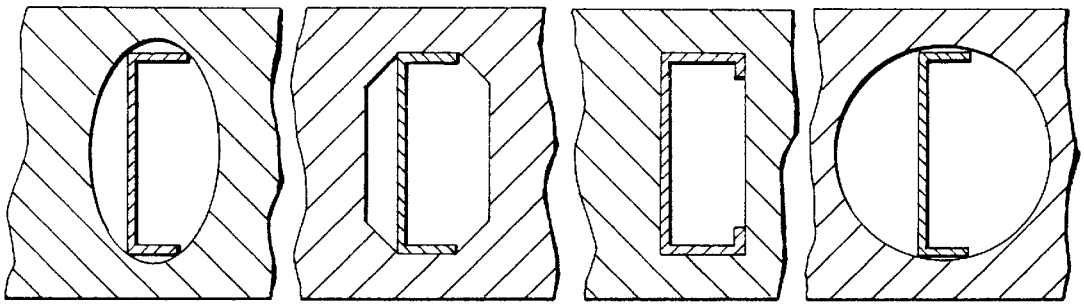
FIG. 10A illustrates a series of four partially cutaway elevational views depicting various block passageway configurations and various block alignment element configurations.
Figure 10B:
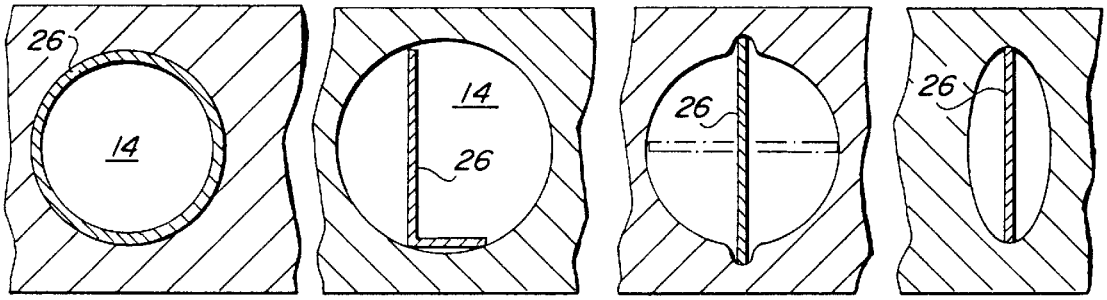
FIG. 10B illustrates a series of four partially cutaway elevational views depicting various block passageway configurations and various block alignment element configurations.
Figure 10C:
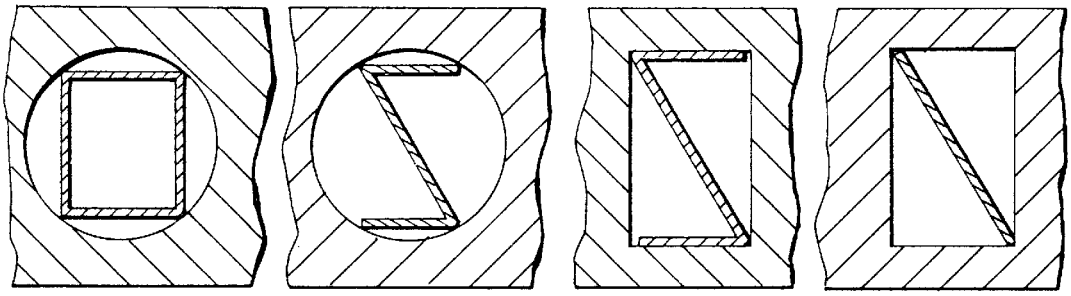
FIG. 10C illustrates a series of four partially cutaway elevational views depicting various block passageway configurations and various block alignment element configurations.

FIGS. 10A, 10B and 10C illustrate a wide variety of alternative configurations for block alignment element 26 of the present invention to demonstrate the structural characteristics of that element required to perform its inventive function and the fact that the structural configuration of that element can assume a wide variety of embodiments and configurations while still performing the necessary alignment and coupling functions. Those same drawing figures also illustrate that the configuration of passageway 14 does not represent a meaningful limitation on the scope of the present invention. Instead, the sixteen alternative embodiments of the present invention illustrated in FIG. 10 demonstrate that the essence of the present invention resides in the contact between two or more spaced apart surfaces on either a continuous or intermittent basis with the vertically oriented passageways extending between the upper and lower surfaces of a single block 12.

As illustrated in FIG. 10B, block alignment elements 26 can take the form of a rectangular sheet having edges which engage the inner surface of passageway 44 at only two spaced apart locations. The L-shaped block alignment element 26 illustrated in FIG. 10B contacts the interior surface of passageway 14 at three angularly spaced apart intervals while the round or tubular block alignment element 26 illustrated in FIG. 10B contacts the interior surface of passageway 14 around essentially its entire circumference. An oval embodiment of the circular block alignment element 26 could also be provided as a fully functional alternative design.

FIGS. 14 and 15 illustrate the use of U-shaped cap sheets 70 configured to fit into receiving grooves located at the upper and lower extremities of block wall 10 to seal off passageways 14 and to provide further reinforcement of block wall 10.

FIGS. 1 and 7 illustrate that a recess can be cut into the exterior surface 52 of block wall 10 to receive electrical conduit 72. The flush mounting provided for electrical conduit 72 still allows drywall sheets to be flush mounted against exterior surface 52 of block wall 10.

The unique structure configuration of the present invention provides a heat high level insulation level by avoiding the use of thermal bridge elements extending between the exterior and interior surfaces of the block wall assembly. As illustrated in FIGS. 8 and 13, only essentially insignificant thermal bridge is created when both exterior and interior wall surfaces are directly connected to the wall by a series of spaced apart fastening devices such as screws 60. Only the small area screw head is exposed to ambient temperature and transmits only a minuscule amount of thermal energy through the wall system of the present invention. While block alignment element 38 may be fabricated from a thermally conductive metal material, it is insulated from both the outside and inside surfaces of blocks 12 by insulating sidewall areas 50.

While the present invention has been described in connection with a particular conventional urethane or styrene foam block design as best illustrated in FIG. 1 utilizing tongue and groove block interlocking structures and four vertical passageways 14, the present invention can accommodate many different forms of block designs as is readily apparent from the sixteen alternative block designs illustrated in FIG. 10. Rebar and concrete grouting may be utilized or omitted to satisfy the structural strength requirements of specific wall applications. It will be readily apparent to those skilled in the art that the disclosed heat insulating block wall design may be modified in numerous other ways and may assume many embodiments other than the preferred forms specifically set out and described above. Accordingly, is intended by the appended claims to cover all such modifications of the invention which fall within the true spirit and scope of the invention.

I claim:

1. A method for fabricating a foam block wall comprising the steps of:

a. providing a plurality of first foam blocks aligned end to end horizontally, each first foam block having an upper surface, a lower surface, opposing, parallel oriented exterior side surfaces and a plurality of first passageways extending vertically between the upper and lower block surfaces and defining a reduced thickness sidewall between the exterior side surface and each first passageway;

b. providing a plurality of second foam blocks aligned end to end horizontally, each second foam block having an upper surface, a lower surface, opposing, parallel oriented exterior side surfaces and a plurality of second passageways extending vertically between the upper and lower block surfaces and defining a reduced thickness sidewall between the exterior surface and each second passageway;

c. positioning the lower surfaces of the plurality of second foam blocks on the upper surfaces of the plurality of first foam blocks with each second passageway aligned with a corresponding first passageway;

d. providing a plurality of block alignment elements, each block alignment element having a first end, a second end, and first and second edge alignment surfaces disposed between the first and second ends and dimensioned to simultaneously engage the first and second passageways of the first and second blocks at angularly spaced apart intervals;

e. positioning each block alignment element through one of the second passageways of one of the second foam blocks and through the second passageway of the second block and through one of the corresponding first passageways of one of the first foam blocks, and further engaging the first and second passageways of the first and second foam blocks with the edge alignment surfaces to align the first and second foam blocks relative to each; and f. grouting a plurality of aligned first and second passageways with a material.

2. The method of claim 1 wherein each block alignment element includes a coupling surface configured to lie in close proximity to the block passageways after the block alignment element has been inserted into the passageways and including the further step of orienting each block alignment element such that the coupling surface is disposed in proximity to the reduced thickness sidewall of at least one block.

3. The method of claim 2 including the further step of securing a wall mountable element to the exterior side surface of the block wall by passing an elongated fastening device through the wall mountable element and through the block sidewall into engagement with the adjacent coupling surface.

4. The method of claim 1, further comprising placing reinforcing bar in the first and second passageways that will be grouted.

5. The method of claim 1, wherein the step of grouting comprises placing concrete in the plurality of aligned first and second passageways.

6. A foam block wall comprising:

a plurality of foam blocks, each foam block having an upper surface, a lower surface and a plurality of passageways extending vertically between the upper and lower foam block surfaces, wherein the plurality of foam blocks are stacked in a wall to form a plurality of aligned passageways that are aligned vertically through the wall;

b. a plurality of block alignment elements, each block alignment element having a first end, a second end and first and second edge alignment surfaces disposed between the first and second ends for simultaneously engaging one of the aligned passageways at angularly spaced apart intervals to maintain alignment of its corresponding aligned passageway; and c. a plurality of concrete columns, each concrete column being formed within one of the aligned passageways.

7. The foam block wall of claim 6 wherein the block alignment element includes a rectangular sheet of substantially rigid material dimensioned to engage the internal passageways of the first and second blocks.

8. The foam block wall of claim 6 wherein the block alignment element includes an L-shaped element engaging the internal passageways of the first and second blocks at first, second and third angularly spaced apart intervals.

9. The foam block wall of claim 6 wherein each block alignment element includes a C-shaped element having a first coupling surface attached to the first edge alignment surface and a second coupling surface attached to the second edge alignment surface.

10. The foam block wall of claim 9 wherein the first coupling surface is oriented parallel to the second coupling surface.

11. The foam block wall of claim 9 wherein a plurality of elongated fastening devices penetrates through a wall-mountable device to secure the wall-mountable device to the block sidewall by penetrating through the sidewall and engaging the first coupling surface.

12. The foam block wall of claim 11 wherein the wall mountable device includes dry wall.

13. The foam block wall of claim 11 wherein the wall mountable device includes an electrical box.

14. The foam block wall of claim 11 wherein the wall mountable device includes exterior siding.

15. The foam block wall of claim 6 wherein the block alignment element includes a tubular member.

16. The foam block wall of claim 6 wherein the block alignment element includes a rectangular cross section having third and fourth edge alignment surfaces for simultaneously engaging the internal passageways of the first and second blocks at four angularly spaced apart intervals.

17. The foam block wall of claim 6 wherein the block alignment element includes a Z-shaped element.

18. The foam block wall of claim 17 wherein the Z-shaped block alignment element includes first and second parallel oriented coupling surfaces.

19. The foam block wall of claim 6, wherein each passageway of the plurality of passageways has a substantially circular cross sectional configuration.

20. The foam block wall of claim 6, wherein each passageway of the plurality of passageways has a substantially rectangular cross sectional configuration.

* * * * *